US009247791B2

(12) United States Patent
Cowin et al.

(10) Patent No.: US 9,247,791 B2
(45) Date of Patent: Feb. 2, 2016

(54) BURST ZIPPER

(71) Applicant: Illinois Tool Works Inc., Glenview, IL (US)

(72) Inventors: Joseph T. Cowin, Phoenix, AZ (US); Henry L. Swain, Whitehouse Station, NJ (US)

(73) Assignee: Illinois Tool Works Inc., Glenview, IL (US)

( * ) Notice: Subject to any disclaimer, the term of this patent is extended or adjusted under 35 U.S.C. 154(b) by 191 days.

(21) Appl. No.: 13/767,534

(22) Filed: Feb. 14, 2013

(65) Prior Publication Data

US 2013/0291350 A1 Nov. 7, 2013

Related U.S. Application Data

(60) Provisional application No. 61/642,791, filed on May 4, 2012.

(51) Int. Cl.

| | |
|---|---|
| ***A44B 19/32*** | (2006.01) |
| ***A44B 19/16*** | (2006.01) |
| *A45C 13/10* | (2006.01) |

(52) U.S. Cl.

CPC ..... *A44B 19/32* (2013.01); *A44B 19/16* (2013.01); *A45C 13/103* (2013.01); *Y10T 24/2532* (2015.01); *Y10T 24/2582* (2015.01)

(58) Field of Classification Search

CPC .... A44B 19/16; A44B 19/32; Y10T 24/2532; A45C 13/103

USPC ..... 24/399

See application file for complete search history.

(56) References Cited

U.S. PATENT DOCUMENTS

| | | | | |
|---|---|---|---|---|
| 2,978,769 | A * | 4/1961 | Harrah | 24/585.12 |
| 3,220,076 | A | 11/1965 | Ausnit et al. | |
| 3,633,642 | A * | 1/1972 | Siegel | 383/64 |
| 5,007,143 | A * | 4/1991 | Herrington | 24/400 |
| 5,020,194 | A * | 6/1991 | Herrington et al. | 24/400 |
| 5,140,796 | A | 8/1992 | Pope | |
| 5,351,369 | A | 10/1994 | Swain | |
| 5,581,854 | A | 12/1996 | Swain | |
| 5,588,187 | A | 12/1996 | Swain | |
| 5,636,415 | A | 6/1997 | James | |
| 5,809,621 | A * | 9/1998 | McCree et al. | 24/399 |
| 6,464,394 | B1 | 10/2002 | Galomb | |
| 7,690,090 | B2 | 4/2010 | Swain et al. | |
| 7,849,565 | B2 | 12/2010 | Swain et al. | |
| 2002/0100144 | A1* | 8/2002 | Machacek et al. | 24/15 |
| 2003/0202718 | A1* | 10/2003 | Tomic | 383/64 |
| 2004/0074058 | A1* | 4/2004 | Thieman | 24/399 |

(Continued)

FOREIGN PATENT DOCUMENTS

EP 0712591 A2 5/1996

OTHER PUBLICATIONS

International Search Report for PCT/US2013/039182 dated Jul. 29, 2013.

*Primary Examiner* — Robert J Sandy
*Assistant Examiner* — Louis Mercado
(74) *Attorney, Agent, or Firm* — Levenfeld Pearlstein, LLC

(57) ABSTRACT

A burst zipper system includes a flexible zipper, a close-only slider and a set of handles. The burst zipper system is configured to be closed by operation of the close-only slider and opened by pulling on the set of handles in opposite directions. The burst zipper system can be used in sports bags, such as duffle bags, and backpacks, in tents, and the like.

19 Claims, 6 Drawing Sheets

(56) References Cited

U.S. PATENT DOCUMENTS

2007/0071367 A1* 3/2007 Buchman ..... 383/64
2011/0158561 A1* 6/2011 Kasai ..... 383/64
2011/0317942 A1* 12/2011 Blythe et al. ..... 383/64
2014/0119678 A1* 5/2014 Ausnit et al. ..... 383/64
2014/0259571 A1* 9/2014 Blythe ..... 24/585.1
2014/0270589 A1* 9/2014 Blythe ..... 383/64

* cited by examiner

BURST ZIPPER

BACKGROUND

The present disclosure generally relates to closure systems, and more particularly to burst zipper systems.

Resilient fasteners are known in the art. Generally, such fasteners include a pair of flexible closure strips, each extruded from a polymeric material in continuous lengths and having interlocking teeth. These fasteners can also be water-tight or leak-proof. Typically, these fasteners are opened and closed by operation of a slider, which runs along the length of the fastener. Examples of such fasteners are disclosed in Swain, U.S. Pat. No. 5,351,369, Swain, U.S. Pat. No. 5,581,854, Swain, U.S. Pat. No. 5,588,187, James, U.S. Pat. No. 5,636,415, Swain, U.S. Pat. No. 7,690,090, and Swain, U.S. Pat. No. 7,849,565, which are commonly assigned with the present application and incorporated herein in their entirety by reference.

Further, flexible closure strips for typical reclosable plastic bags are also available. These closure strips can be closed by compressing the closure strips together using fingers or by operation of a slider or other devices to facilitate interlocking of the strips. These flexible closure strips can be opened by grabbing edges of the closure strips or edges of the bag and pulling apart the closure strips. Examples of such flexible closure strips are disclosed in Ausnit, U.S. Pat. No. 3,220,076 and Pope, U.S. Pat. No. 5,140,796, which are incorporated herein in their entirety by reference. However, it is not always easy or convenient to get a good grip on the edges quickly to pull apart the closure strips. Further, some of the flexible closure strips include laterally interlocking teeth creating a vertically high profile closure system. Other low-profile closure systems are design to have low interlocking strength such that the closure systems can be easily pulled apart by pulling on the edges.

Accordingly, there is a need for an improved low-profile flexible closure system that can provide higher interlocking strength with an easier and faster opening solution.

BRIEF SUMMARY

Burst zipper systems are provided according to various embodiments. The burst zipper system includes a low profile, flexible zipper that includes two closure strips, which can be interlocked by operation of a bi-directional slider and opened by pulling on strategically placed handles or internal pockets. The zipper can be configured to be water resistant or leak-proof. The burst zipper systems provide quick, hassle-free closure and opening of the zipper, have a low profile and sufficiently high interior burst strength to maintain objects, such as sports bags, closed during intended uses.

In one aspect, a burst zipper system including a zipper, a slider, and a set of handles is provided. The zipper has a length and includes a first closure strip and a second closure strip. The first closure strip includes a first interlocking member and a first web portion, and the second closure strip includes a second interlocking member and a second web portion. The slider is configured to fit around the zipper. The set of handles includes at least two handles which are arranged directly opposite each other across the zipper. Further, the zipper is configured to be closed by the slider, which joins the first and second interlocking members as the slider runs along the length of the zipper, and opened by pulling on the set of handles. Preferably, the slider is a bi-directional, close-only slider, and the zipper is a flexible zipper extruded from a polymeric material.

In one embodiment, the first interlocking member is an arrow-head shaped male member and the second interlocking member is a female member configured to receive the arrow-shaped male member. The female member includes barbs to secure the arrow-head shaped male member in the female member. Further, the first closure strip includes a first tab. The first tab and the first web portion extend in the same direction away from the arrow-shaped male member, and define a first channel behind the arrow-shaped male member. Similarly, the second closure strip includes a second tab, and the second tab and the second web portion extend in the same direction away from the female member. The second tab and the second web portion define a second channel behind the female member.

In such an embodiment, the slider can include rails configured to fit in the first and second channels and to compress the first and second interlocking members together to close the zipper as the slider moves along the length of the zipper in either direction. The slider also includes a pull strap mounted on a top exterior surface of the slider. Alternatively, the slider includes spinning disks configured to roll inside the first and second channels in either direction to compress and interlock the first and second interlocking members.

In an embodiment, the first interlocking member includes a first set of teeth and the second interlocking member includes a second set of teeth. The first set of teeth and the second set of teeth are configured to interlock with each other in an interference fit. Each of the first web portion and the second web portion is bent at least once to position the first set of teeth and the second set of teeth to face each other. For example, the first web portion is bent at multiple different locations and the second web portion is bent once to provide four sides for the slider to ride on. In such an embodiment, the first set of teeth and the second set of teeth interlock longitudinally with each other.

Alternatively, the first web portion can be bent once at 90°, and the second web portion is bent once at 90°, such that the first and second sets of teeth interlock longitudinally with each other. Further, the first closure strip includes a rib extending away from the first set of teeth and parallel with the first web portion. The slider is configured to fit around the first and second interlocking members, and includes a channel configured to fit around the rib. The rib and the channel together facilitate the slider securely running along the length of the zipper. In yet another embodiment, the first and second interlocking members are configured to face each other laterally and interlock with each other laterally.

In some embodiments, the slider includes bearing elements arranged substantially in-line with the first and second interlocking members, which are configured to facilitate compressing together the first and second interlocking members and also to reduce drag. The slider can also include a top wall receiver for receiving a pull tab or c-rings on its exterior side walls, and a pull cord having two pull tabs provided through the c-rings.

In one embodiment, the set of handles include a first handle and a second handle. The first and the second handles are semi-looped handles. The first handle is attached on the first web portion. The second handle is attached on the second web portion directly opposite from the first handle across the zipper, such that the first and second handles can be pulled in opposing directions to separate the first and second interlocking members after they have been interlocked with each other.

In another embodiment, the set of handles include a first handle, a second handle, a third handle, and a fourth handle. The first and second handles intersect each other and are arranged on a first closure member side of the zipper. Similarly, the third and fourth handles intersect each other and are arranged on a second closure member side of the zipper. In this embodiment, the second handle is attached on the first web portion and the third handle is attached on the second web portion. The first handle is aligned adjacent the second handle and attached to a bag to which the zipper is attached. Similarly, the fourth handle is aligned adjacent the third handle and attached to the bag. The first, second, third, and fourth handles are aligned and arranged such that the first and second handles can be pulled together in one direction, and the third and fourth handles can be pulled together in the opposite direction to separate the first and second interlocking members after they have been interlocked with each other.

In yet another embodiment, the set of handles includes a first handle, a second handle, a third handle, and a fourth handle. The first and second handles are arranged along the first web portion together and attached at three attachment locations, and the third and fourth handles are arranged along on the second web portion together and attached at three attachment locations. The set of handles are arranged such that the first and second handles can be pulled in one direction and the third and fourth handles are pulled in the opposite direction to separate the first and second interlocking members after they have been interlocked with each other. In this embodiment, the first and second handles can be formed from a single strip of material and separated by an attachment location. Similarly, the third and the fourth handles can be formed from a single strip of material separated by an attachment location. The set of handles are attached via welding, stitching or by using an adhesive. Alternatively, the set of handles are provided in the form of internal pockets.

In any of the above embodiments, the slider is configured to rejoin the first and second interlocking members after they have been separated by pulling on the set of handles.

Other aspects, objectives and advantages will become more apparent from the following detailed description when taken in conjunction with the accompanying drawings.

BRIEF DESCRIPTION OF THE DRAWINGS

The benefits and advantages of the present embodiments will become more readily apparent to those of ordinary skill in the relevant art after reviewing the following detailed description and accompanying drawings, wherein.

DETAILED DESCRIPTION

Figure 1:
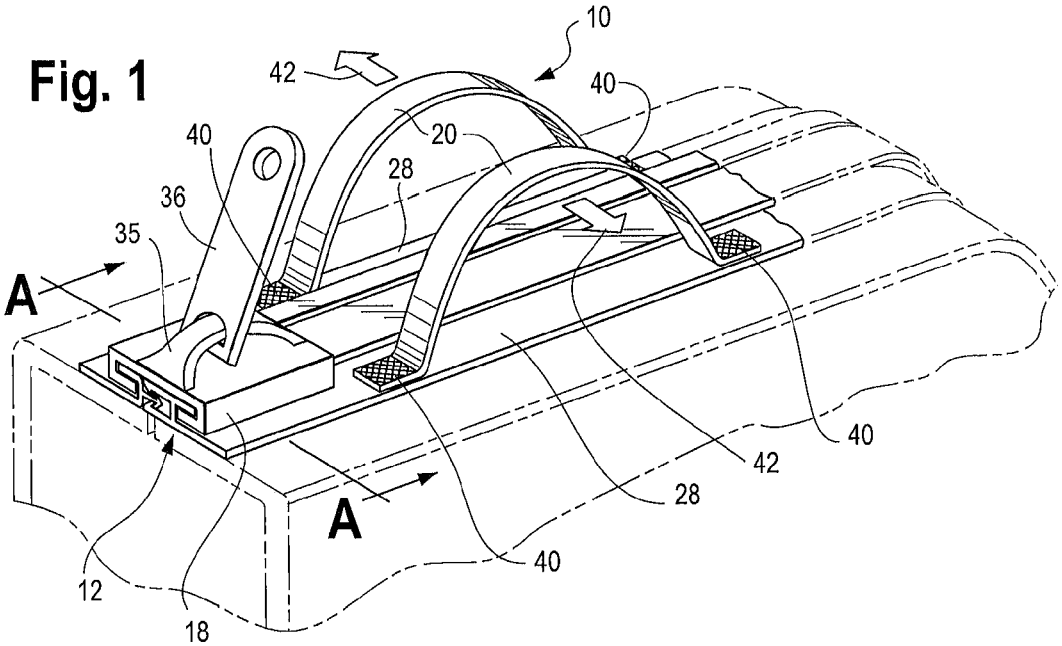
FIG. 1 is a perspective view illustrating a burst zipper system including an "arrow lock" type zipper according to an embodiment.

While the present disclosure is susceptible of embodiment in various forms, there is shown in the drawings and will hereinafter be described presently preferred embodiments with the understanding that the present disclosure is to be considered an exemplification and is not intended to limit the disclosure to the specific embodiments illustrated. The words "a" or "an" are to be taken to include both the singular and the plural. Conversely, any reference to plural items shall, where appropriate, include the singular.

Figure 2:
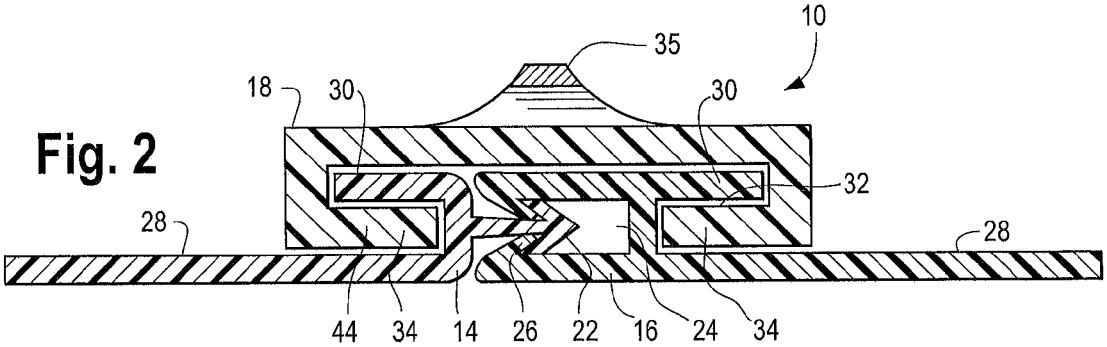
FIG. 2 is a schematic cross sectional view of the "arrow lock" type zipper of FIG. 1 taken along line A-A.

Referring now to the figures, FIGS. 1 and 2 illustrate an embodiment of a burst zipper system 10. The burst zipper system 10 generally includes a zipper 12 comprising a male half 14 and a female half 16, a slider 18, and a pair of handles 20. The burst zipper system 10 is configured such that the zipper 10 can be closed by the slider 18 and opened by pulling on the handles 20.

The male half 14 includes a male interlocking member 22, which may, as illustrated, be in the form of an arrow-head. As such, the zipper 12 is also referred to herein as an "arrow-lock" type zipper. The female half 16 includes a female interlocking member 24, which may be in the form of a receptacle into which the male interlocking member 22 may be inserted. Barbs 26 prevent the male interlocking member 22 from being easily disengaged from the female interlocking member 24 once they are joined as shown in FIGS. 1 and 2. As configured, the male and female halves 14, 16 provide a low profile zipper having sufficiently high internal burst strength to maintain objects, such as sports bags, duffel bags, backpacks, and the like in a closed state during their intended use.

Both the male half 14 and the female half 16 include web portions 28 to which a fabric, leather, or polymeric material may be sewn or otherwise attached, such as by welding or an adhesive. Parallel to the web 28 on both the male half 14 and the female half 16 is a tab 30. Both the web 28 and the tab 30 extend in the same direction away from the male interlocking member 22 and the female interlocking member 24. The webs 28 and the tabs 30 define a channel 32 behind each of the male and female interlocking members 22, 24. The channels 32 are configured to fit with, e.g., accommodate, the slider 18 and provide a path for the slider 18 to travel along the length of the zipper 12 as the slider 18 compresses the male and female interlocking members 22, 24 to close the zipper 12.

The male half 14 and the female half 16 can provide a low profile reclosable zipper system, which is water resistant when closed. The male half 14 and the female half 16 can be extruded from suitable polymeric materials, or molded therefrom. Examples of suitable polymeric materials include but are not limited to polyurethane, polyester, vinyl, polyethylene such as high-density polyethylene, and polypropylene.

The slider 18 is a bi-directional close-only slider, which is configured to compress the male half 14 and the female half 16 together. For purposes of the present disclosure, a bi-directional close-only slider is a slider that is moved along the zipper 12 in either direction to compress and close the male and female 14, 16 portions of the zipper 12 and does not open the zipper 12 when moved in a reverse direction. The slider 18 includes rails 34 which fit in the channels 32 and travel along the length of the zipper 12, while maintaining the necessary compression, to join the male and female halves 14, 16 together along their entire length. The slider 18, as shown in FIGS. 1 and 2, includes a receiver 35 for a top-mounted pull tab 36.

Figure 3:
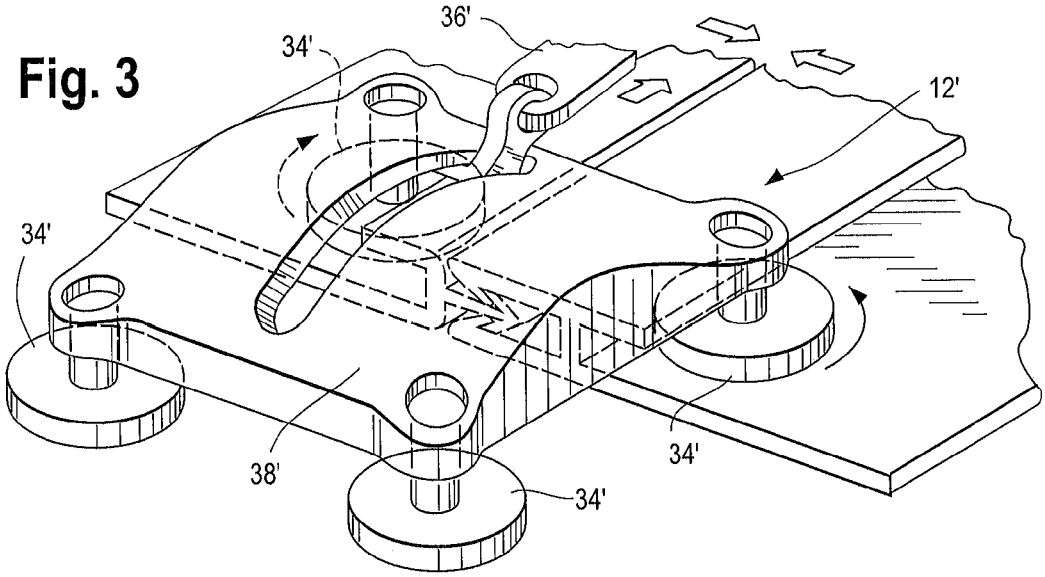
FIG. 3 is a perspective view of a bi-directional slider according to another embodiment.

FIG. 3 shows a slider 18' according to another embodiment. The slider 18' includes four rotating disks 34' that rotate inside channels 32 of the two zipper halves 14, 16 (FIGS. 1 and 2). The disks 34' are cantilevered from (e.g. mounted below) a top portion 38' of the slider 18'. The slider 18' also includes a top mounted pull tab 36'.

The burst zipper system 10 also includes a pair of handles 20 for opening functionality. The handles are referred to as "burst straps" or "burst handles" or other similar terms in this disclosure. As shown in FIG. 1, the handles 20 are semi-looped and are attached to the webs 28 of the male and female halves 14, 16. Each of the handles 20 is attached to the web 28 at two different locations 40 (total of four attachment areas 40 for the pair of handles 20). The handles 20 may be attached by welding, stitching, adhesive, or other suitable methods. The handles 20 are strategically placed on the webs 28 directly opposite each other across the zipper 12, such that a user can easily grab and pull on the handles 20 in opposing directions (as indicated at 42) to open the zipper 12. The pair of handles 20 can be used with other zipper embodiments, such as those illustrated in FIGS. 5, 8, and 9, and discussed in detail herein.

Figure 13A:
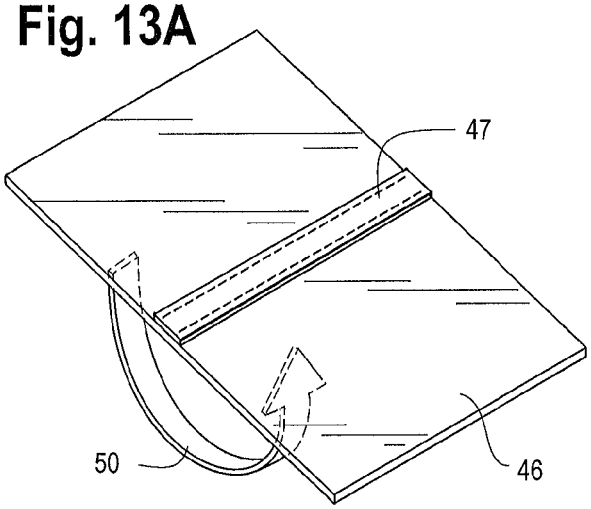
FIG. 13A is a perspective view of a rectangular material member for an internal burst pocket according an embodiment.
Figure 13B:
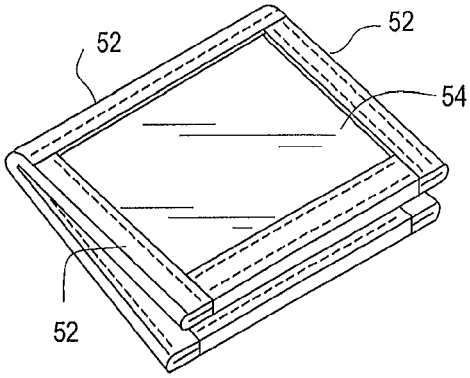
FIG. 13B is a perspective view of the rectangular material member of FIG. 13A folded and welded to form the internal burst pocket.
Figure 13C:
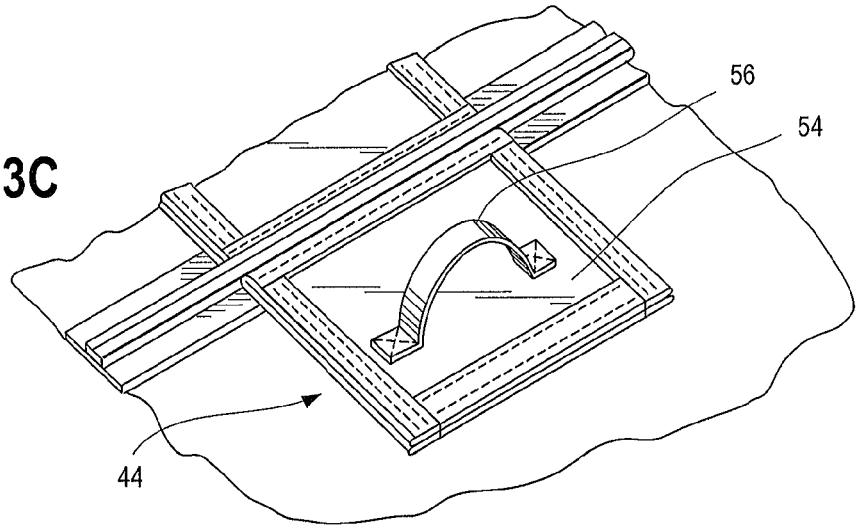
FIG. 13C is a perspective view of the internal burst pocket attached to a burst zipper according to an embodiment.
Figure 14:
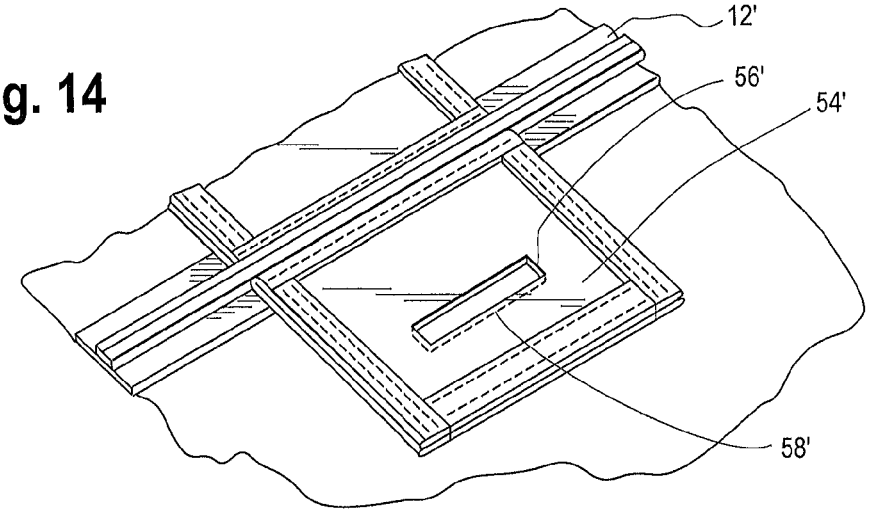
FIG. 14 is a perspective view of an internal burst pocket according to another embodiment.

The burst zipper system 10 can include burst straps of other embodiments, such as those illustrated in FIGS. 4, 6, 7, and 9, and discussed in detail below. Alternatively, the burst zipper system 10 can include internal burst handles 44 as shown in FIGS. 13-14. As shown in FIG. 13A, a generally rectangular pocket material 46 is attached to the web 28 or to a material of the object to be closed (not shown), such as the fabric of a bag, along its middle area 47. The pocket material 46 is folded under as indicated at 50, and the peripheral edges 52 are welded together or attached together by a suitable method to form an internal pocket 54. (FIGS. 13A and 13B.) The internal pocket 54 is provided with a reinforced handle 56. (FIG. 13C.) The burst zipper system 10 can include a pair of such internal pockets 54, which can be attached opposite each other on the web portions 28 across the zipper 12, such that the internal burst handles 44 can be pulled in opposite directions to open the zipper 12. The internal burst handles 44 can be used with other zipper embodiments, such as those illustrated in FIGS. 5, 8, and 9, and discussed in detail herein.

FIG. 14 illustrates an internal pocket 54' according to another embodiment. The internal pocket 54' is constructed similarly to the internal pocket 54, except the internal pocket 54' does not include a separately attached handle. Instead, a reinforced cut-out 56' is provided in the top layer of the internal pocket 54', such that a user can grab the reinforced cut-outs 56' and pull in opposite directions to open a zipper 12'. The reinforced cut-out 56' is formed when a portion of the internal pocket 54' is cut out and sewn around (as indicated at, for example, 58') for reinforcement.

Figure 4:
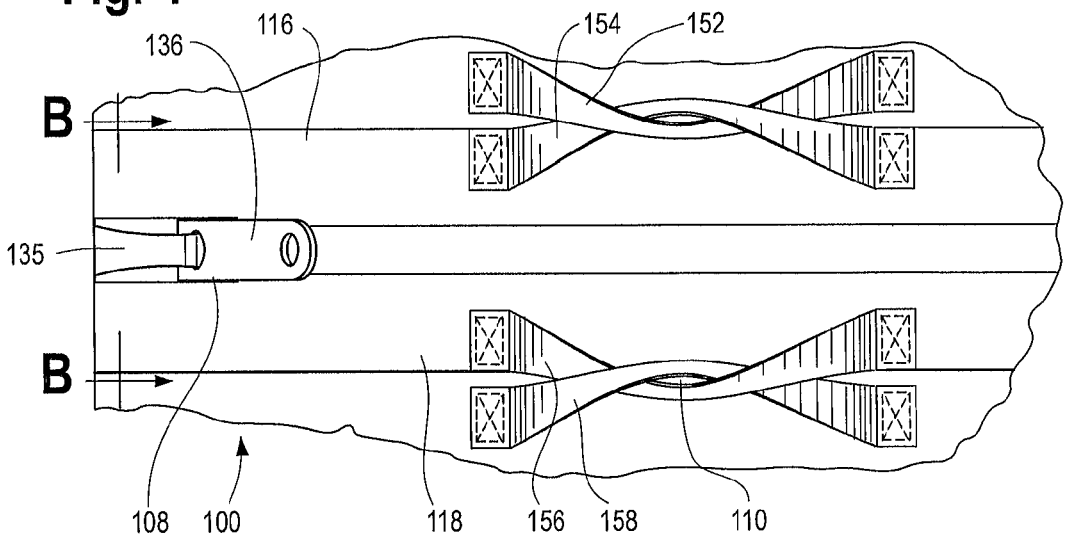
FIG. 4 is a top view illustrating a burst zipper system including a zipper having two closure strips with vertically interlocking teeth according to an embodiment.
Figure 5:
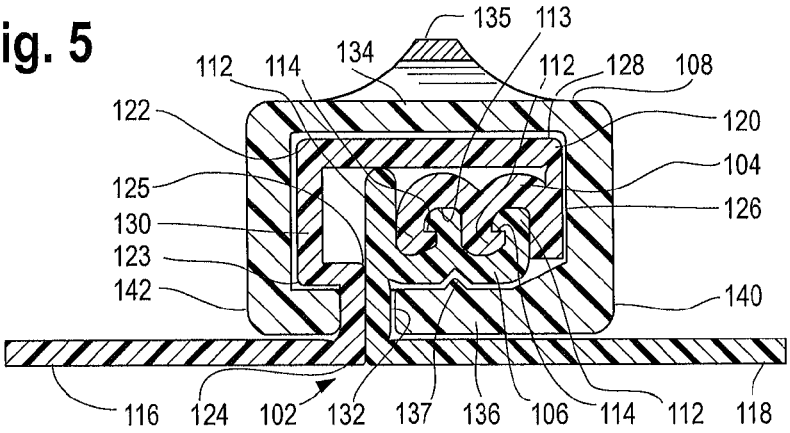
FIG. 5 is a schematic cross sectional view of the zipper of FIG. 4 taken along line B-B.

FIGS. 4 and 5 show a burst zipper system 100 according to another embodiment. As it was with the burst zipper system 10 of the previous embodiment, the burst zipper system 100 generally includes a zipper 102, a bi-directional slider 108, and a set of handles 110. The burst zipper system 100 is configured such that the zipper 102 can be closed by the bi-directional slider 108 and opened by pulling on the handles 110. The zipper 102 includes a first closure strip 104 and a second closure strip 106. Each of the closure strips 104, 106 includes solid form-retaining longitudinally extending teeth 112 and channels 113 defined therebetween. Preferably, the teeth 112 are continuous. The channels 113 are generally complementary to the teeth 112, so that they may lock together as shown in FIG. 5. The teeth 112 include undercut interlocking hooks 114, and thus, matching undercut interlocking grooves are defined in the channels 113, such that the teeth 112 are longitudinally interlocked in an interference fit by engagement of the hooks 114 with the grooves.

The first and second closure strips 104, 106 include web portions 116, 118. As shown in FIG. 5, the web 116 of the first closure strip 104 is bent at multiple different places 120, 122, 123, 124, 125 such that the teeth 112 of the first closure strip 104 are oriented to face the second closure strip 106. The web 118 of the second closure strip 106 is bent once, such that the teeth 112 of the second closure strip 106 face the teeth 112 of the first closure strip 104. Such a configuration of the first and closure strips 104, 106 also provides for a zipper 102 having four available sides 126, 128, 130, 132 for the slider 108 to ride on.

The integrated four sided slider 108 is a bi-directional, close-only slider. The interior of the slider 108 is configured to fit around the zipper 102 and includes side walls, which are generally planar and function to hold the slider 108 in place. As seen, a lower interior wall 136 of the slider 108 may include a ridge line to facilitate compressing of the first and second closure strips 104, 106 together to interlock the teeth 112 as the slider 108 runs along the length of the zipper 102. Alternately, the ridge line can be positioned at the upper interior wall (not shown) or on both the lower and upper walls.

The exterior of the slider 108 is generally rectangular in shape with generally planar walls. The top wall can include a receiver 35 to receive, for example, a pull tab 136 or the like for pulling the slider 108.

Alternatively, although not shown, the slider may have concave exterior side walls with increasing wall thickness from the middle area toward the front and back ends. In such an embodiment, the concave side walls having thicker wall thicknesses at the ends provide a comfortable and secure finger grip position for operating the slider in either direction.

Further the burst zipper system 100 can include the set of handles 110 for opening the zipper 102. In the embodiment shown in FIG. 4, the set of handles 110 includes four semi-looped handles 152, 154, 156, 158. The handles 152 and 154 are arranged on the first closure strip 104 side of the zipper 102 and configured to intersect each other. The handles 156, 158 are arranged on the second closure strip 106 side of the zipper 102 and configured to intersect each other. The handle 154 and the handle 156 are attached on the web portions 116, 118 of the first and second closure strips 104, 106, respectively. The handles 154, 156 are arranged such that they are aligned directly opposite each other across the zipper 102. The handle 152 is aligned with the handle 154 and attached to a material of an object to be closed, such as a fabric of a sports bag. Similarly, the handle 158 is aligned with the handle 156 and attached on to the material of the object to be closed. The handles 152, 154, 156, 158 may be welded, stitched, or otherwise attached using any conventional methods. As such, the handles 152, 154, 156, 158 are aligned with two handles on each side of the zipper 102, such that a user can easily grab the handles and pull in opposing directions and generally perpendicular to the zipper 102 to burst open the zipper 102.

Figure 6:
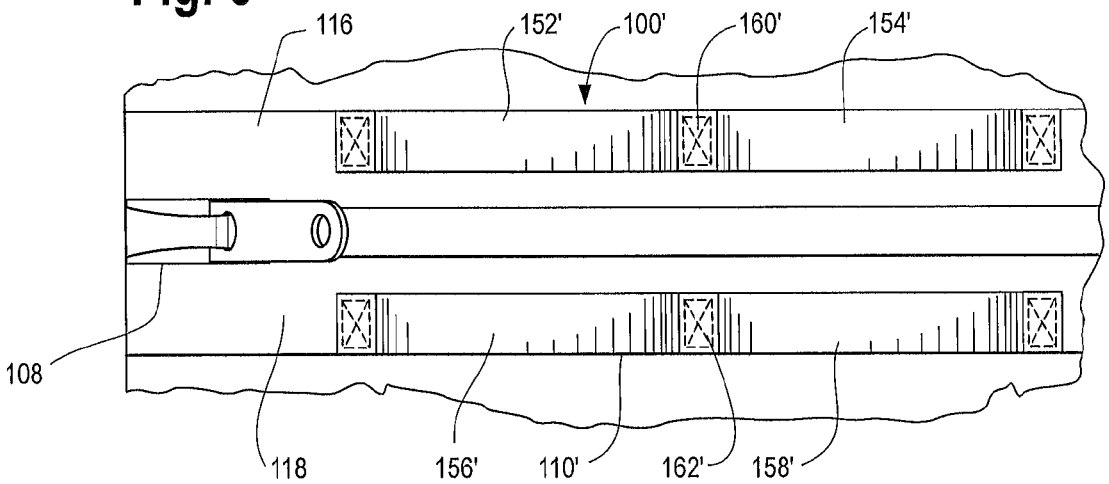
FIG. 6 is a top view illustrating the zipper of FIG. 4 with a different type of burst handle.

FIG. 6 illustrates a burst zipper system 100' according to a yet another embodiment. Details of the burst zipper system 100' are the same as the burst zipper system 100 of the previous embodiment, except that a set of handles 110' includes four semi-looped handles 152', 154', 156', 158'. The handles 152' and 154' are attached on the web portion 116 of the first closure strip 104, and the handles 156' and 158' are attached on the web portion 118 of the second closure strip 106. The handles 152' and 154' are laterally aligned with each other and share an attachment area 160'. The handles 152' and 154' may be formed of a single strip of a material with the attachment area 160' separating the material into two handles 152', 154'.

Alternatively, the handles 152' and 154' may be formed of two separate strips of a material, ends of which are attached in the attachment area 160'. Similarly, the handles 156' and 158' are laterally aligned with each other and share an attachment area 162', and may be formed of a single strip of a material or two separate strips of a material. The handles 152' and 156' are arranged directly opposite each other across the zipper 102. Similarly, the handles 154' and 158' are arranged directly opposite each other across the zipper 102, such that a user can grab the handles 152', 154', 156', 158' and pull in opposing directions to burst open the zipper 102. In other embodiments, the zipper 102 can be provided with other types of burst handles, such as those shown in FIGS. 1, 4, 7, 9, 13C, and 14.

Figure 7:
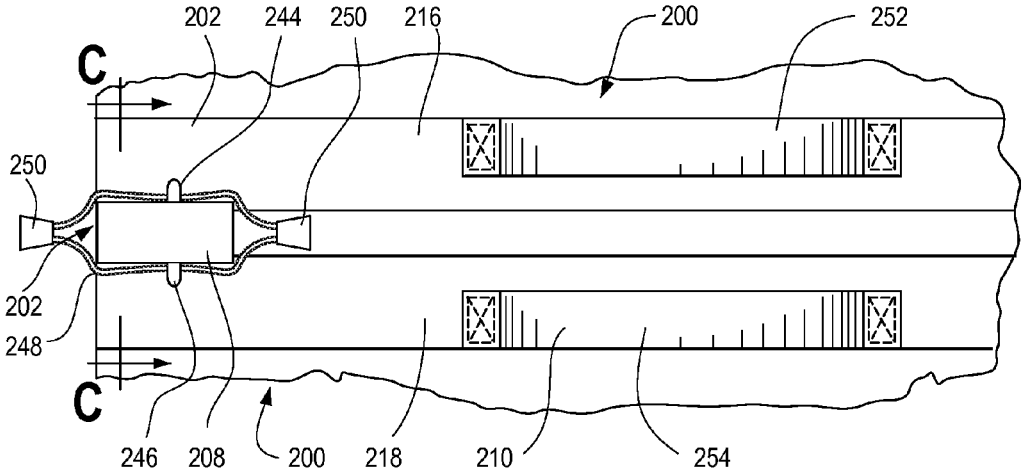
FIG. 7 is a perspective view illustrating a burst zipper system including a zipper having two closure strips with vertically interlocking teeth according to yet another embodiment.
Figure 8:
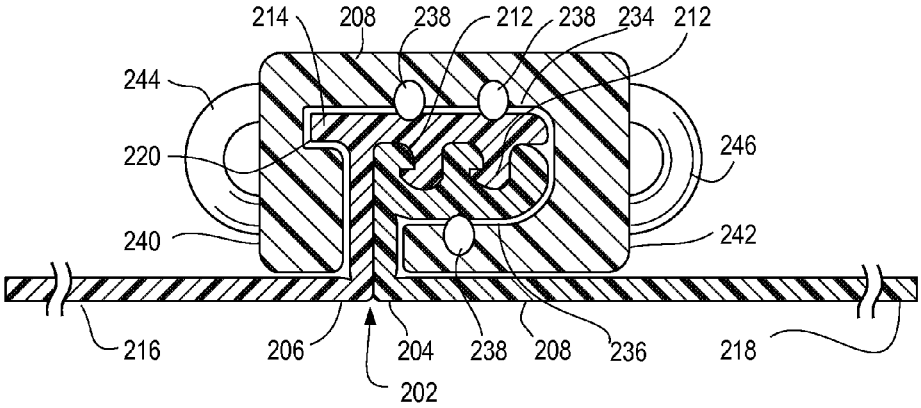
FIG. 8 is a schematic cross sectional view of the zipper of FIG. 7 taken along line C-C.
Figure 9:
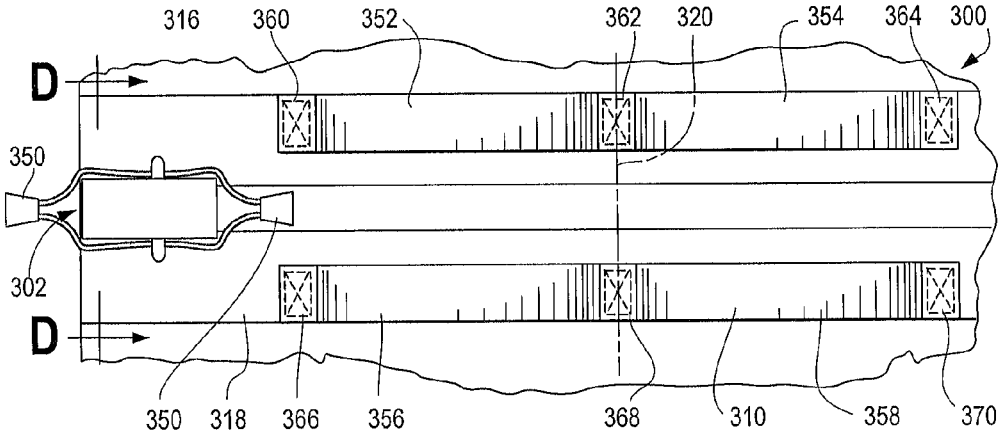
FIG. 9 is a top view illustrating a burst zipper system according to still an embodiment.

FIGS. 7 and 8 show a burst zipper system 200 according to another embodiment. The burst zipper system 200 generally includes a zipper 202, a bi-directional slider 208, and a set of handles 210. The burst zipper system 200 is configured such that the zipper 202 can be closed by the bi-directional slider 208, and opened by pulling on the handles 210. The zipper 202 is similarly configured as the zipper 102 of the previous embodiment, and includes a first closure strip 204 and a second closure strip 206, each having interlocking teeth 212 and longitudinal channels defined therebetween. The teeth 212 of the first and second closure strips 204, 206 are configured to interlock in an interference fit.

The first closure strip 204 of this embodiment includes a rib 214, which fits in a corresponding channel 220 defined in an interior of the slider 208 to secure the slider 208 in place. The first and second closure strips 204, 206 also include web portions 216, 218. The web portion 216 of the first closure strip 204 is bent once, which eliminates the double profile wall of the zipper 102 created by multiple bending of the first closure strip 104. Thus, the zipper 202 provides for a lower profile zipper than the zipper 102. The zipper 202 also reduces the required pull force to burst open the zipper 202 when compared to the zipper 102, however, the internal burst strength is reduced as well.

The bi-directional slider 208 is similarly configured as the slider 108 and has a generally rectangular exterior. In this embodiment, two c-rings 244, 246 are positioned on the side walls 240, 242, through which, for example, a pull cord 248 is secured. The pull cord 248 includes opposite facing pull tabs 250 to facilitate pulling of the slider 208 by either hand in either direction to close the zipper 202. The pull cord 248 may be a nylon braided cord or other device suitable for pulling the bi-directional slider 208. The pull cord 248 can include pull tabs 250 to secure the cord to the slider.

The interior of the slider 208 is configured to fit around the sides of the zipper 202 such that the slider 208 can securely run along the length of the zipper 202. The channel 220, which is configured to fit around the rib 214 of the first closure strip 204, provides added security for the slider 208 to remain in place during closing of the zipper 202.

In addition, in this embodiment, optionally, an upper interior wall 234 and a lower interior wall 236 of the slider 208 include one or more bearing elements or surfaces 238, for example, such as the illustrated ball bearings, which create a wave-like internal cross section on the upper and lower interior walls 234, 236. The bearings 238 can be arranged substantially in-line with the interlocking teeth 212 on the first and second closure strips 204, 206. The bearings 238 are configured to facilitate compressing the first and second closure strips 204, 206 together to interlock the teeth 212 as the slider 108 runs along the length of the zipper 202. The bearings 238 cans also be configured to reduce drag. The bearings 238 function in a similar manner to the ridgeline 137 shown in the slider embodiment 108 of FIG. 5.

The set of handles 210 includes handles 252 and 254, each of which are attached on the web portions 216, 218 of the first and second closure strips 204, 206, respectively. As it was with previous embodiments, the handles 252 and 254 are arranged directly opposite each other across the zipper 202, such that the handles 252, 254 can be pulled in opposite directions and generally perpendicular to the zipper 202 to burst open the zipper 202. The zipper 202 can be used with other types of handles such as the handles in other embodiments shown and described in the present disclosure.

FIGS. 9-12 illustrate a burst zipper system 300 according to yet another embodiment. The burst zipper system 300 generally includes a zipper 302, a bi-directional close-only slider 308, and a set of handles 310. The burst zipper system 300 is configured such that the zipper 302 can be closed by the bi-directional slider 308 and burst opened by pulling on the handles 310. The zipper 302 includes a first closure strip 304 and a second closure strip 306, each having interlocking teeth 312 and channels defined therebetween.

The teeth 312 of the first and second closure strips 304, 306 are configured to interlock with each other in an interference fit. Each of the web portions 316, 318 is bent once at 90°, such that the teeth 312 of the first closure strip 304 laterally face the teeth 312 of the second closure strip 306. The web portion 318 of the second closure strip 306 is bent further away from the teeth 312 than the first closure strip 304, such that when teeth 312 are interlocked with each other, the top tooth 314 of the second closure strip 306 overlaps the top tooth 315 of the first closure strip 315. As configured, teeth 312 of the first and second closure strips 304, 306 laterally interlock with each other, and thus, the zipper 302 has a higher vertical profile than the zippers 102 and 202 of the previous embodiments having longitudinally interlocking teeth.

Figure 10:
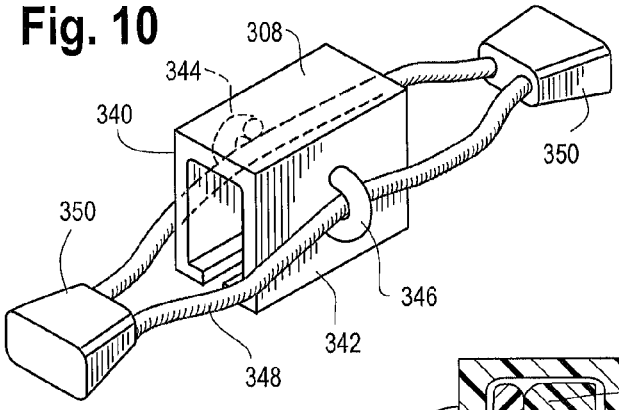
FIG. 10 is a perspective view illustrating a c-type slider for the zipper of FIG. 9.
Figure 11:
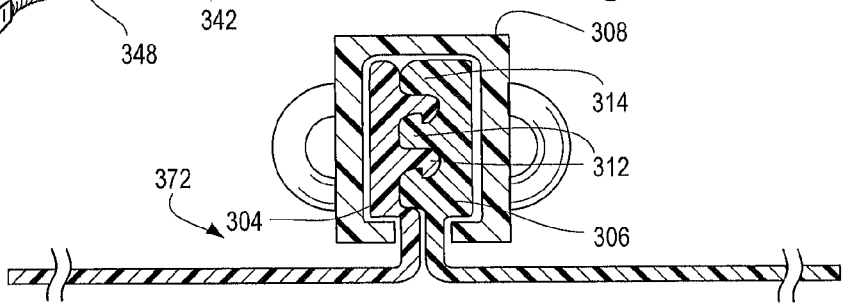
FIG. 11 is a schematic cross sectional view of the zipper of FIG. 9 including a zipper having two closure strips with laterally interlocking teeth taken along liner D-D.

The slider 308 as shown in FIG. 10 is a simple c-type slider, which fits around the zipper 302 to run along the length of the zipper in either direction to closer the zipper 302. C-rings 344, 346 can be provided on side walls 340, 342 of the slider 308, through which a pull cord 348 with two pull tabs 350 is secured for easy and secure closure of the zipper 312 by either hand in either direction. It will be appreciated by those skilled in the art that this embodiment of the slider 308 can include a top mounted pull-tab such as that illustrated in FIG. 1.

Figure 12:
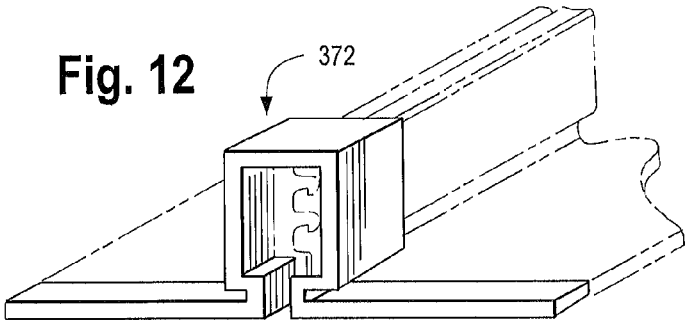
FIG. 12 is a schematic front view illustrating an end cap for the zipper of FIG. 9.

FIG. 12 shows an end cap 372, which is configured to be placed at the ends of the zipper 302 to prevent the slider 308 from sliding off the ends of the zipper 302. Previously described zipper embodiments can also include similar end caps. The end cap 372 may be injection molded using a suitable polymeric material that is weld compatible with the polymeric materials of the zipper.

The set of handles 310 is similarly configured to the set of handles 110' of the above-described embodiment shown in FIG. 6. The set of handles 310 includes four semi-looped handles 352, 354, 356, 358. The handles 352 and 354 can be formed of a single strip of material and attached on the web 316 at multiple locations such as at the three locations 360, 362, 364 shown. Alternatively, the handles 352 and 354 can be formed of two separate strips of material, ends of which share the attachment area 362. Similarly, the handles 356 and 358 may be formed of a single strip of material or two separate strips of material, and are attached on the web 318 at three locations 366, 368, 370. Preferably, the handles 352, 354, 356, 358 are attached such that attachment locations are aligned and directly opposite each other across the zipper 302 (360 opposite 366, 362 opposite 368, and 364 opposite 370.) Further, the set of handles 310 is centered along the length of the zipper 202 by arranging the attachment locations 362 and 368 generally along a center line 320 of the zipper 202.

In one embodiment, the zipper 12 is attached to a bag, such as a sports bag, a duffle bag and a backpack. In such embodiment, edges of the bag to be closed are attached to the webs 28 by suitable means, such as by sewing, welding or by an adhesive.

Figure 15:
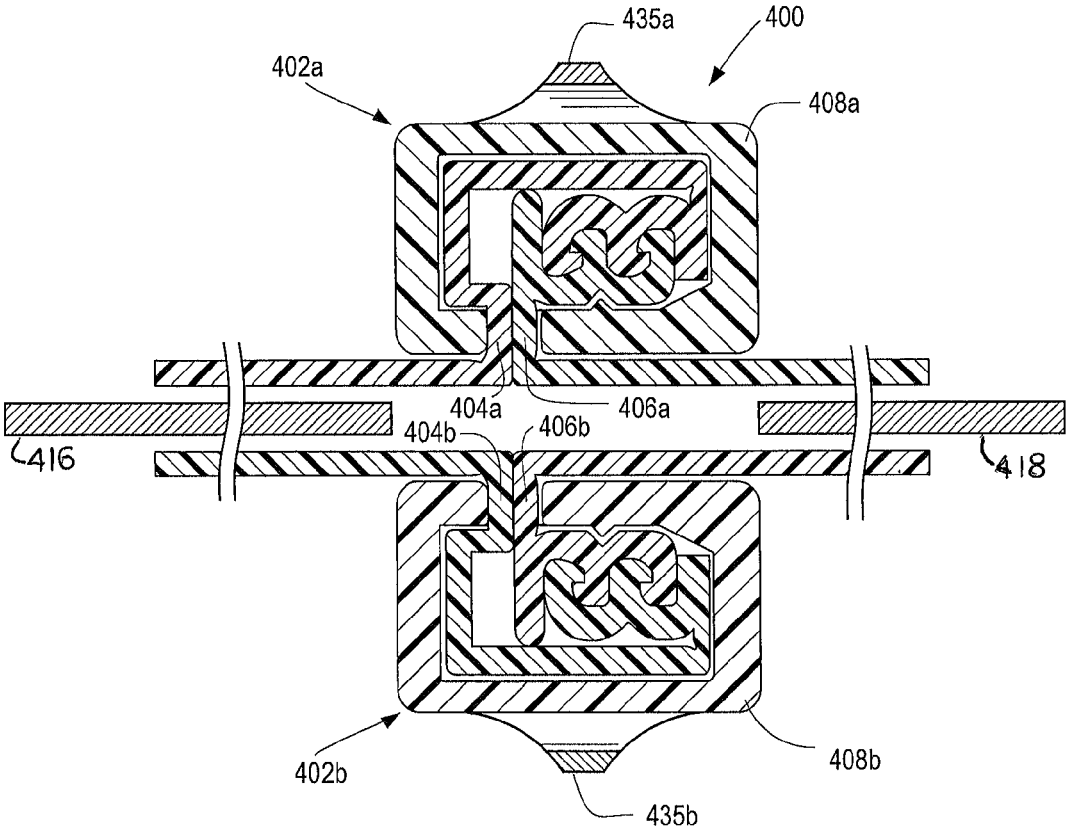
FIG. 15 is a cross-section view of a dual zipper system in which two zippers are present across opposing webs, and in which the zippers can be opened from either side of the webs.

FIG. 15 illustrates an embodiment of the burst zipper system 400 in which two zippers 402*a*, 402*b* span a single set of webs 416, 418. Such a configuration can be used, for example, in a camping tent or the like, where it may be desirable to open and close a zipper from either or both sides. The sliders 408*a*, 408*b* and closure strips 404*a,b*, 406*a,b* can be configured such as that illustrated, which is similar to the slider 108 and closure strips 104, 106 of the embodiment of FIG. 5 or can take any of the other disclosed slider and strip configurations. Likewise, although top mounted pull tab receivers 435*a,b* are illustrated, other tabs or pulls can be used with this two zipper configuration. Burst handles or pockets such as those illustrated herein are provided on the webs 416, 418 adjacent to the zippers 402*a,b* to pull the zippers open. It will be appreciated by those skilled in the art that the burst handles or pockets can be provided so that the zippers can be opened from with side, for example, for the inside or the outside of a tent, and that such handles or pockets will serve to open either or both zippers which ever may be closed. That is, in this embodiment 400, the zippers 402*a,b* are positioned on either side of a web 416, 418 and each is configured to close the web independently, and each zipper 402*a,b* is configured such that either or both sets of handles can open one or both of the zippers 402*a,b* independently.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover by the appended claims all such modifications as fall within the scope of the claims.

What is claimed is:

1. A burst zipper system, comprising:

a zipper having a length, the zipper including a first closure strip and a second closure strip, wherein the first closure strip includes a first interlocking member and a first web portion, and the second closure strip includes a second interlocking member and a second web portion;

a slider configured to fit around the zipper; and a set of handles, the set of handles including at least two handles which are arranged substantially directly opposite each other and spaced apart across the zipper, such that the slider is slidable between the at least two handles, wherein the zipper is configured to be closed by the slider, which joins the first and second interlocking members as the slider runs along the length of the zipper, and opened by pulling on the set of handles, and wherein the set of handles are attached via welding, stitching or by using an adhesive.

2. The burst zipper system of claim 1, wherein the slider is a bi-directional, close-only slider.

3. The burst zipper system of claim 1, wherein the zipper is a flexible zipper extruded from a polymeric material.

4. The burst zipper system of claim 1, wherein the first interlocking member includes a first set of teeth and the second interlocking member includes a second set of teeth, the first set of teeth and the second set of teeth configured to interlock with each other in an interference fit, and wherein each of the first web portion and the second web portion is bent at least once to position the first set of teeth and the second set of teeth to face each other.

5. The burst zipper system of claim 4, wherein the first web portion is bent at five locations and the second web portion is bent once to provide four sides for the slider to ride on, and wherein the first set of teeth and the second set of teeth interlock longitudinally with each other.

6. The burst zipper system of claim 4, wherein the first web portion is bent once at 90° and the second web portion is bent once at 90°, wherein the first and second sets of teeth interlock longitudinally with each other, and wherein the first closure strip includes a rib extending away from the first set of teeth and parallel with the first web portion.

7. The burst zipper system of claim 6, wherein the slider is configured to fit around the first and second interlocking members, and includes a channel configured to fit around the rib, and wherein the rib and the channel together facilitate the slider to securely run along the length of the zipper.

8. The burst zipper system of claim 4, wherein the slider includes one or more bearing elements arranged substantially in-line with one or both of the first and second interlocking members, the one or more bearing elements configured to facilitate compressing of the first and second interlocking members together.

9. The burst zipper system of claim 4, wherein the first and second interlocking members face each other laterally and interlock with each other laterally.

10. The burst zipper system of claim 4, wherein the slider is configured to fit around the first and second interlocking members, and includes a receiver on an exterior wall to receive a pull element to facilitate movement of the slider along the zipper to close the zipper.

11. The burst zipper system of claim 1, wherein the set of handles includes a first handle and a second handle, the first and the second handles being semi-looped handles, wherein the first handle is attached on the first web portion and the second handle is attached on the second web portion opposite from the first handle across the zipper, such that the first and second handles are pulled in opposing directions to separate the first and second interlocking members after they have been interlocked with each other.

12. The burst zipper system of claim 1, wherein the set of handles includes a first handle, a second handle, a third handle, and a fourth handle, wherein the first and second handles intersect each other and are arranged on a first closure member side of the zipper, and the third and fourth handles intersect each other and are arranged on a second closure member side of the zipper, wherein the second handle is attached on the first web portion and the third handle is attached on the second web portion, and the first handle is aligned adjacent the second handle and attached to a bag to which the zipper is attached, and the fourth handle is aligned adjacent the third handle and attached to the bag, wherein the first, second, third, and fourth handles are aligned and arranged such that the first and second handles are pulled together in one direction, and the third and fourth handles are pulled together in the opposite direction to separate the first and second interlocking members after they have been interlocked with each other.

13. The burst zipper system of claim 1, wherein the set of handles includes a first handle, a second handle, a third handle, and a fourth handle, wherein the first and second handles are arranged along the first web portion together and attached at three attachment locations, and the third and fourth handles are arranged along the second web portion together and attached at three attachment locations, wherein the set of handles are arranged such that the first and second handles are pulled in one direction and the third and fourth handles are pulled in the opposite direction to separate the first and second interlocking members after they have been interlocked with each other.

14. The burst zipper system of claim 13, wherein the first and second handles are formed from a single strip of material and separated by an attachment location, and the third and the fourth handles are formed from a single strip of material separated by an attachment location.

15. The burst zipper system of claim 1, wherein the set of handles are provided in the form of internal pockets.

16. The burst zipper system of claim 1 including two zippers each including a respective slider and each including a respective set of handles, the zippers positioned on either side of a web and each configured to close the web independently, each zipper configured such that either or both sets of handles can open one or both of the zippers independently.

17. A burst zipper system, comprising:

a zipper having a length, the zipper including a first closure strip and a second closure strip, wherein the first closure strip includes a first interlocking member and a first web portion, and the second closure strip includes a second interlocking member and a second web portion;

a slider configured to fit around the zipper; and a set of handles, the set of handles including at least two handles which are arranged substantially directly opposite each other across the zipper, wherein the zipper is configured to be closed by the slider, which joins the first and second interlocking members as the slider runs along the length of the zipper, and opened by pulling on the set of handles, and wherein the first interlocking member is an arrow-head shaped male member and the second interlocking member is a female member configured to receive the arrow-head shaped male member, the female member including barbs to secure the arrow-head shaped male member in the female member, wherein the first closure strip includes a first tab, and the first tab and the first web portion extend in a same first direction away from the arrow-head shaped male member, and the first tab and the first web portion define a first channel behind the arrow-head shaped male member, and wherein the second closure strip includes a second tab, and the second tab and the second web portion extend in a same second direction away from the female member, the second tab and the second web portion defining a second channel behind the female member.

18. The burst zipper system of claim 17, wherein the slider includes rails configured to fit in the first and second channels and to compress the first and second interlocking members together to close the zipper as the slider moves along the length of the zipper in either direction, and the slider includes a pull strap mounted on a top exterior surface of the slider.

19. The burst zipper system of claim 17, wherein the slider includes rotating elements configured to rotate inside the first and second channels in either direction to compress and interlock the first and second interlocking members.

* * * * *